US011690406B2

(12) United States Patent
Lai

(10) Patent No.: US 11,690,406 B2
(45) Date of Patent: Jul. 4, 2023

(54) ELECTRONIC CIGARETTE, ATOMIZING CORE, ATOMIZER AND METHOD OF CONTROLLING ELECTRONIC CIGARETTE

(71) Applicant: SHENZHEN SMOORE TECHNOLOGY LIMITED, Shenzhen (CN)

(72) Inventor: Baosheng Lai, Shenzhen (CN)

(73) Assignee: SHENZHEN SMOORE TECHNOLOGY LIMITED, Shenzhen (CN)

( * ) Notice: Subject to any disclaimer, the term of this patent is extended or adjusted under 35 U.S.C. 154(b) by 544 days.

(21) Appl. No.: 16/485,775

(22) PCT Filed: Apr. 18, 2018

(86) PCT No.: PCT/CN2018/083516
§ 371 (c)(1),
(2) Date: Aug. 13, 2019

(87) PCT Pub. No.: WO2019/200559
PCT Pub. Date: Oct. 24, 2019

(65) Prior Publication Data

US 2021/0360977 A1 Nov. 25, 2021

(51) Int. Cl.
*A24F 40/53* (2020.01)
*A24F 40/60* (2020.01)
(Continued)

(52) U.S. Cl.
CPC ..... *A24F 40/53* (2020.01); *A24F 40/40* (2020.01); *A24F 40/50* (2020.01); *A24F 40/51* (2020.01); *A24F 40/60* (2020.01)

(58) Field of Classification Search
CPC ..... A24F 40/65; A24F 40/53
See application file for complete search history.

(56) References Cited

U.S. PATENT DOCUMENTS

2017/0000192 A1* 1/2017 Li ..... G05B 15/02
2017/0215480 A1 8/2017 Qiu
(Continued)

FOREIGN PATENT DOCUMENTS

| | | |
|---|---|---|
| CN | 204146340 | 2/2015 |
| CN | 106263040 | 1/2017 |
| CN | 106690422 | 5/2017 |

OTHER PUBLICATIONS

"Search Report of Europe Counterpart Application", dated Feb. 25, 2020, p. 1-p. 11.
(Continued)

*Primary Examiner* — Anthony Calandra
(74) *Attorney, Agent, or Firm* — JCIP Global Inc.

(57) ABSTRACT

The invention discloses an electronic cigarette, an atomizing core, an atomizer and a method of controlling the electronic cigarette. The electronic cigarette comprises a battery assembly, an atomizer comprising an atomizer body and an atomizing core mounted on the atomizer body, and a main control circuit; the main control circuit comprises a sense unit for sensing remaining life cycle of the atomizing core, a compare unit for comparing data sensed by the sense unit with a preset threshold value, and a control unit for controlling on and off of the electronic cigarette depending on comparison results. Through the invention, the user can use the atomizing core in any atomizer having electrical interfaces, and close output at an optimal time of taste of the atomizing core and before producing harmful substance.

7 Claims, 3 Drawing Sheets

(51) Int. Cl.

| | |
|---|---|
| ***A24F 40/40*** | (2020.01) |
| ***A24F 40/50*** | (2020.01) |
| ***A24F 40/51*** | (2020.01) |

(56) References Cited

U.S. PATENT DOCUMENTS

| | | | | |
|---|---|---|---|---|
| 2017/0311384 | A1* | 10/2017 | Wu | A61M 11/042 |
| 2018/0020735 | A1 | 1/2018 | Bilat et al. | |
| 2018/0192702 | A1* | 7/2018 | Li | H05B 1/0277 |

OTHER PUBLICATIONS

"International Search Report (Form PCT/ISA/210) of PCT/CN2018/083516," dated Jan. 9, 2019, pp. 1-5.
"International Search Report (Form PCT/ISA/210) of PCT/CN2018/083516," dated Jan. 9, 2019, with English translation thereof, pp. 1-7.
"Written Opinion of the International Searching Authority (Form PCT/ISA/237) of PCT/CN2018/083516,," datede Jan. 9, 2019, with English translation thereof, pp. 1-8.
The First Office Action of China Counterpart Application No. 201810348884.8, with English translation thereof, dated Mar. 14, 2019, pp. 1-12.
The Second Office Action of China Counterpart Application No. 201810348884.8, with English translation thereof, dated Aug. 14, 2019, pp. 1-13.
Notice of Reexamination of China Counterpart Application No. 201810348884.8, with English translation thereof, dated Apr. 21, 2021, pp. 1-23.
Rejection decision of China Counterpart Application No. 201810348884.8, with English translation thereof, dated Dec. 5, 2019, pp. 1-11.
Reexamination decision of China Counterpart Application No. 201810348884.8, with English translation thereof, dated Sep. 18, 2021, pp. 1-36.

* cited by examiner

ELECTRONIC CIGARETTE, ATOMIZING CORE, ATOMIZER AND METHOD OF CONTROLLING ELECTRONIC CIGARETTE

CROSS-REFERENCE TO RELATED APPLICATION

This application is a 371 of international application of PCT application serial no. PCT/CN2018/083516, filed on Apr. 8, 2018. The entirety of the above mentioned patent application is hereby incorporated by reference herein and made a part of this specification.

TECHNICAL FIELD

The invention relates to a supply for smokers, and more specifically, particular to an electronic cigarette and a method of controlling the same.

BACKGROUND ART

With development of electronic cigarette techniques from mouth suction cigarettes to lung suction big cigarettes, regardless of safety or support of rich tastes, there is a large improvement. However, as a core component of producing atomization, the atomizing core has a limited life. When life of the atomizing core reaches a certain level, taste of smoking becomes worse, and a large number of harmful substances to human body also will be produced, thereby affecting body health of the user.

SUMMARY OF THE INVENTION

The technical problem to be solved by the invention is to provide an electronic cigarette, an atomizing core, an atomizer and a method of controlling the electronic cigarette against the deficiency of disability in acquisition and control in advance when the atomizing core produces harmful substances, thereby affecting health of the user in the prior art.

The technical solution of the invention adopted to solve the technical problem is to construct an electronic cigarette, comprising a battery assembly, an atomizer comprising an atomizer body and an atomizing core mounted on the atomizer body, and a main control circuit, the main control circuit comprises a sense unit for sensing remaining life cycle of the atomizing core, a compare unit for comparing data sensed by the sense unit with a preset threshold value, and a control unit for controlling on and off of the electronic cigarette depending on comparison results.

Preferably, in the electronic cigarette of the invention, the atomizing core is detachably mounted on the atomizer body;

the atomizing core comprises an atomizing core body, an identity identification element mounted in the atomizing core body for identifying identity of the atomizing core, and a first electrical interface electrically connected to the atomizer body, the identity identification element being electrically connected to the first electrical interface;

the atomizing core further comprises a remaining life cycle memory element.

Preferably, in the electronic cigarette of the invention, the remaining life cycle memory element is disposed in the identity identification element.

Preferably, in the electronic cigarette of the invention, the identity identification element is an ID chip.

Preferably, in the electronic cigarette of the invention, the remaining life cycle memory element is a readable and writable memory.

Preferably, in the electronic cigarette of the invention, the atomizer body is provided with a second electrical interface electrically connected to the atomizing core.

Preferably, in the electronic cigarette of the invention, the main control circuit further comprises a reminder unit for sending a reminding message of exchanging the atomizing core.

Preferably, in the electronic cigarette of the invention, the main control circuit is disposed in the battery assembly.

The invention further constructs an atomizing core for detachably mounted on an atomizer body, the atomizing core comprises an atomizing core body, an identity identification element mounted in the atomizing core body for identifying identity of the atomizing core, and a first electrical interface electrically connected to the atomizer body, the identity identification element being electrically connected to the first electrical interface;

the atomizing core further comprises a remaining life cycle memory element.

Preferably, in the atomizing core of the invention, the remaining life cycle memory element is disposed in the identity identification element.

Preferably, in the atomizing core of the invention, the identity identification element is an ID chip.

Preferably, in the atomizing core of the invention, the remaining life cycle memory element is a readable and writable memory.

The invention further constructs an atomizer, comprising an atomizer body detachably connected to an atomizing core, characterized in that the atomizer body is provided with a second electrical interface electrically connected to the atomizing core.

The invention further constructs a method of controlling an electronic cigarette, the electronic cigarette comprising a battery assembly, an atomizer comprising an atomizer body and an atomizing core detachably mounted on the atomizer body, and a main control circuit, the method comprises steps of:

S1: after power on, acquiring stored information in the atomizing core, checking whether a disable lock identifier exists, if yes, executing step S6, otherwise, executing step S2;

S2: sensing remaining life cycle of the atomizing core;

S3: judging whether the remaining life cycle of the atomizing core has reached a preset threshold value, if yes, executing step S5, otherwise, executing step S4;

S4: updating the remaining life cycle stored in the atomizing core, and continuing to execute the step S2;

S5: writing the disable lock identifier into the atomizing core; and

S6: sending a reminding message, and disconnecting power connection of the electronic cigarette.

Preferably, in the method of controlling an electronic cigarette of the invention, the step S1 further comprises:

after power on, acquiring identity identification of an identity identification element in the atomizing core and stored information of a remaining life cycle memory element in the atomizing core through a first electrical interface on the atomizing core.

Preferably, in the method of controlling an electronic cigarette of the invention, the step S2 further comprises:

recording operation time of the atomizing core, timely acquiring operation parameters of the atomizing core through the first electrical interface on the atomizing core, timely calculating consumed life cycle based on the acquired operation time and operation parameters, and obtaining latest remaining life cycle.

Preferably, in the method of controlling an electronic cigarette of the invention, the step S4 further comprises: updating the latest remaining life cycle into the remaining life cycle memory element 112 of the atomizing core 11.

Preferably, in the method of controlling an electronic cigarette of the invention, the step S5 further comprises: writing a disable lock identifier into the remaining life cycle memory element 112 of the atomizing core 11.

Implementing an electronic cigarette, an atomizing core, an atomizer and a method of controlling the electronic cigarette of the invention has the following advantageous effects:

Since the present invention designs the identity identification element, electrical interfaces and remaining life cycle memory element in the atomizing core, the user can use the atomizing core in any atomizer body having electrical interfaces anytime and anywhere, can accurately acquire whether the service life of the atomizing core has reached an upper limit in different atomizers, and close output at an optimal time of taste of the atomizing core and before producing harmful substances, so that the atomizing core stops working, and the user is reminded to exchange a new atomizing core to ensure body health of the user.

BRIEF DESCRIPTION OF THE DRAWINGS

Hereinafter, the invention is further described with reference to the accompanying drawings and embodiments. In the drawings.

DETAILED EMBODIMENT OF THE INVENTION

Hereinafter various aspects of the disclosure of the present invention are described. It shall be understood that teachings of the invention can be embodied in many forms, and any specific structure, function or both disclosed in the invention are merely representative. Based on teachings of the invention, those skilled in the art shall understand that one aspect disclosed by the invention can be implemented independent of any other aspect, and two or more of these aspects can be combined in various manners. In order to clearly understand the technical features, objects and effects of the invention, now detailed embodiments of the invention are explicitly described with reference to the accompanying drawings.

Some embodiments of the invention provide an electronic cigarette, which can close output at an optimal time of taste of the atomizing core and before producing harmful substances, so that the atomizing core stops working, and the user is reminded to exchange a new atomizing core. The working principle of the new electronic cigarette system is that after power on each time, dormancy awakening, or reloading an atomizer or atomizing core, the new electronic cigarette actively acquires data of attenuation degree of the atomizing core, i.e., remaining life cycle, in a remaining life cycle memory element of the atomizing core, and checks a disable lock identifier. If the disable lock identifier does not exist after checking, a main control circuit of the battery enters into readiness, and waits for a starting ignition and smoking command. If the disable lock identifier exists after checking, it means that service life of the current atomizing core has reached an upper limit, and the main control circuit of the new electronic cigarette sends a message of exchanging the atomizing core to the user to remind the user that a normal smoking mode can be started again only after the atomizing core is exchanged.

Figure 1:
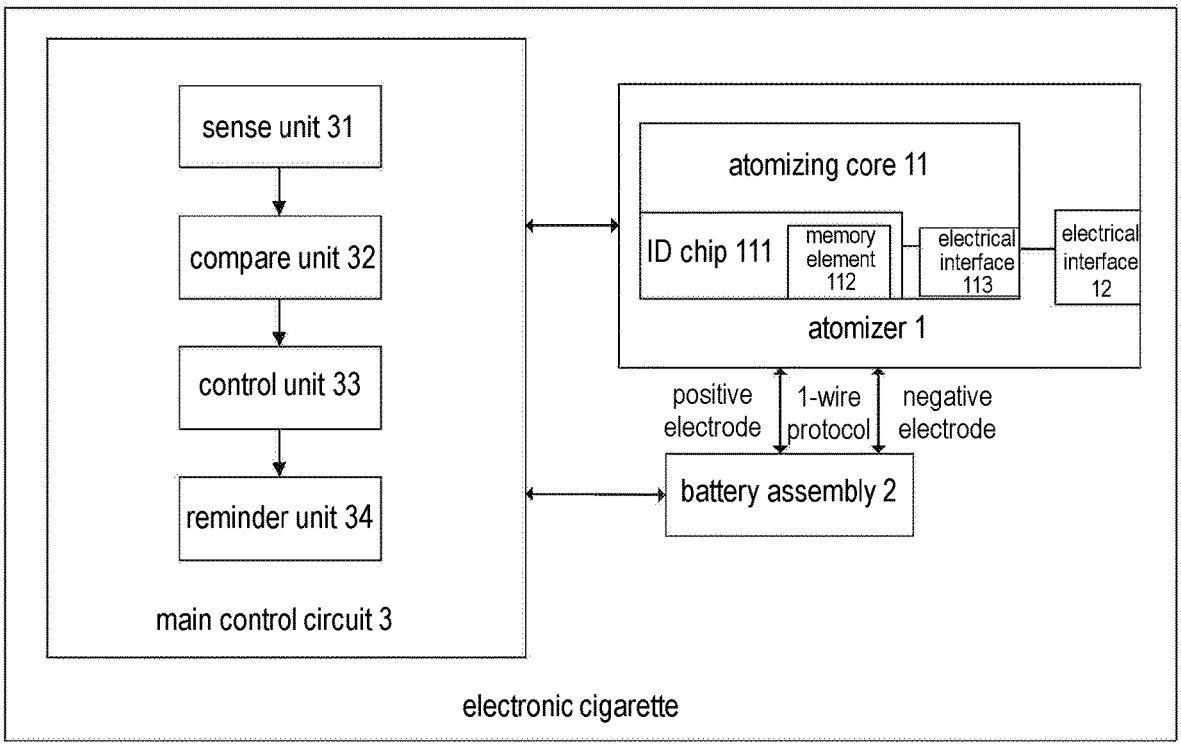
FIG. 1 is a structural diagram of an electronic cigarette in the invention.

As for the first embodiment, please refer to FIG. 1, which illustrates a structural diagram of an electronic cigarette. The electronic cigarette comprises a battery assembly 2, an atomizer 1 comprising an atomizer body and an atomizing core 11 mounted on the atomizer body, and a main control circuit 3, characterized in that the main control circuit 3 comprises a sense unit 31 for sensing remaining life cycle of the atomizing core 11, a compare unit 32 for comparing data sensed by the sense unit 31 with a preset threshold value, and a control unit 33 for controlling on and off of the electronic cigarette depending on comparison results.

In the electronic cigarette of the invention, the atomizing core 11 is detachably mounted on the atomizer body; the atomizing core 11 comprises an atomizing core body, an identity identification element 111 mounted in the atomizing core body for identifying identity of the atomizing core 11, and a first electrical interface 113 electrically connected to the atomizer body, the identity identification element 111 being electrically connected to the first electrical interface 113; and the atomizing core 11 further comprises a remaining life cycle memory element 112.

In the electronic cigarette of the invention, the remaining life cycle memory element 112 is disposed in the identity identification element 111, the identity identification element 111 is an ID chip, the remaining life cycle memory element 112 is a readable and writable memory, and the atomizer body is provided with a second electrical interface 12 electrically connected to the atomizing core 111. The main control circuit 3 further comprises a reminder unit 34 for sending a reminding message of exchanging the atomizing core 11. Moreover, preferably, the main control circuit 3 is disposed in the battery assembly 2.

Specifically, the electronic cigarette may comprise hardware portions and software portions.

The hardware portions comprise:

(1) the atomizing core 11: it is detachably mounted on the atomizer body. The atomizing core 11 is provided with an ID chip 111 as a unique identity identifier, and the ID chip 111 is used by the main control circuit 3 to identify identity of the atomizing core 11. The atomizing core 11 is further provided with the remaining life cycle memory element 112 and the first electrical interface 113 electrically connected to the atomizer body and the ID chip 111. In this embodiment, the remaining life cycle memory element 112 is preferably disposed in the atomizing core 11, and in some other embodiments, the remaining life cycle memory element 112 also may be disposed on the atomizer body. At this time, the unique identity identifier stored in the ID chip 111 of the atomizing core 11 is used as a judging basis to judge whether the atomizing core 11 is used or not in the remaining life cycle memory element 112. Details are not described here.

(2) the atomizer 1: the atomizer 1 of the invention comprises the atomizer body and the atomizing core 11 mounted on the atomizer body, and the atomizer body is provided with the second electrical interface 12 electrically connected to the atomizing core 11. Moreover, in some other embodiments described above, the remaining life cycle memory element 112 also may be disposed on the atomizer body, and the memory element is used as a device to record attenuation degree of the atomizing core 11. When making specific records, the atomizing core ID and the remaining life cycle of the atomizing core 11 are recorded. Details are not described here.

(3) the battery assembly 2: since the main control circuit 3 of the invention is disposed in the battery assembly, when the atomizer 1 is connected to the battery assembly 2 each time, the main control circuit 3 in the battery assembly 2 acquires stored information of the remaining life cycle memory element 112 in the atomizing core 11 to judge whether the disable lock identifier exists. If yes, it means that the atomizing core 11 has reached the maximum service life, power connection between the battery assembly 2 and the atomizer 1 is disconnected, and a reminding message of exchanging the atomizing core 11 is sent to the user. If the disable lock identifier does not exist, after completion of starting ignition each time, smoking time and operation parameters including operation power, voltage, temperature, times of mouth suction and the like at that time are recorded, latest remaining life cycle of the atomizing core 11 is calculated, and then the latest remaining life cycle is compared with a preset threshold value to timely judge whether the atomizing core 11 has reached the maximum service life. If yes, the disable lock identifier is written into the remaining life cycle memory element 112 of the atomizing core 11, power connection with the atomizer 1 is disconnected, and the reminding message of exchanging the atomizing core 11 is sent to the user. If no, the latest remaining life cycle is written into the remaining life cycle memory element 112 of the atomizing core 11, and recording and calculating operations are continued to be completed.

The software portions may comprise:

(1) the main control circuit 3: after the atomizer 1 is powered each time, it firstly acquires stored information of the remaining life cycle memory element 112 in the atomizing core 11 to judge whether the disable lock identifier exists. If yes, it means that the atomizing core 11 has reached the maximum service life, power connection between the battery assembly 2 and the atomizer 1 is disconnected, and a reminding message of exchanging the atomizing core 11 is sent to the user. If the disable lock identifier does not exist, after completion of starting ignition each time, smoking time and operation parameters including operation power, voltage, temperature, times of mouth suction and the like at that time are recorded, latest remaining life cycle of the atomizing core 11 is calculated, and then the latest remaining life cycle is compared with a preset threshold value to judge whether the atomizing core 11 has reached the maximum service life. If yes, the disable lock identifier is written into the remaining life cycle memory element 112 of the atomizing core 11, power connection between the battery assembly 2 and the atomizer 1 is disconnected, and the reminding message of exchanging the atomizing core 11 is sent to the user. If no, the latest remaining life cycle is written into the remaining life cycle memory element of the atomizing core 11, and detecting, timing and calculating operations are continued to be completed. This part of function units and mainframe program together form the main control circuit 3.

(2) an ID identifier: every new atomizing core has a unique identity identifier ID, which is a basis of identifying different atomizing cores in the invention. However, in some other embodiments, when the remaining life cycle memory element 112 is disposed on the atomizer body, the identity identifier ID is also used as a basis to judge whether the same atomizing core is a new one or a used one. Details of the embodiment are not described here.

(3) the remaining life cycle memory element 112: it is a memory core of the entire electronic cigarette for storing remaining life cycle of the atomizing core 11. Moreover, preferably, the remaining life cycle memory element 112 of the invention is a readable and writable memory.

Further, the electronic cigarette comprises the battery assembly 2, the atomizer 1 and the main control circuit 3. Since the main control circuit 3 is disposed in the battery assembly 2, the invention shares wires for data communication and power supply in a positive electrode of the atomizer 1, and communicates using 1-Wire protocol, which largely simplifies connection of wires for both data communication and power supply between the atomizer 1 and the battery assembly 2, and can implement solution of the new electronic cigarette without changing the interface between the current battery and the atomizer.

The atomizer 1 comprises the atomizer body and the atomizing core 11 detachably mounted on the atomizer body, and the atomizer body is provided with the second electrical interface 12 electrically connected to the atomizing core 11. The atomizing core 11 further comprises the first electrical interface 113 electrically connected to the atomizer body. The second electrical interface 12 and the first electrical interface 113 are used for electrically connection to transmit data, and also completing mechanical connection and fixing. It can be understood that the second electrical interface 12 in the atomizer 1 is connected to a positive wire in a manner of data transmission, but it is not limited thereto. When the electronic cigarette operates, data of the atomizing core 11 are transmitted to the positive wire of the atomizer 1 through electrical connections of the first electrical interface 113 and the second electrical interface 12, and then data are transmitted to the main control circuit 3 in the battery assembly 2 through the positive wire of the power supply of the atomizer 1. Each function unit in the main control circuit 3 completes timely sensing, comparing and controlling of the remaining life cycle of the atomizing core 11 correspondingly.

The atomizing core 11 further comprises the ID chip 111 for identifying identity of the atomizing core 11, and the ID chip 111 is electrically connected to the first electrical interface 113. The atomizing core 11 further comprises the remaining life cycle memory element 112. In a preferable embodiment of the invention, the remaining life cycle memory element 112 is a readable and writable memory, and is disposed in the ID chip 111 for storing latest available remaining life cycle of the atomizing core 11. When the remaining life cycle reaches an internal preset threshold value, the electronic cigarette automatically sends a reminding message of exchanging the atomizing core 11, and disconnects power supply from the battery assembly 2. In some other embodiments, the remaining life cycle memory element 112 may be separately disposed on the atomizing core body or the atomizer body, and also may be other types of memory. Details are not described here.

The main control circuit 3 comprises the sense unit 31 for sensing remaining life cycle of the atomizing core 11, the compare unit 32 for comparing data sensed by the sense unit 31 with a preset threshold value, the control unit 33 for controlling on and off of the electronic cigarette depending on comparison results, and the reminder unit 34 for sending a reminding message of exchanging the atomizing core 11.

Figure 2:
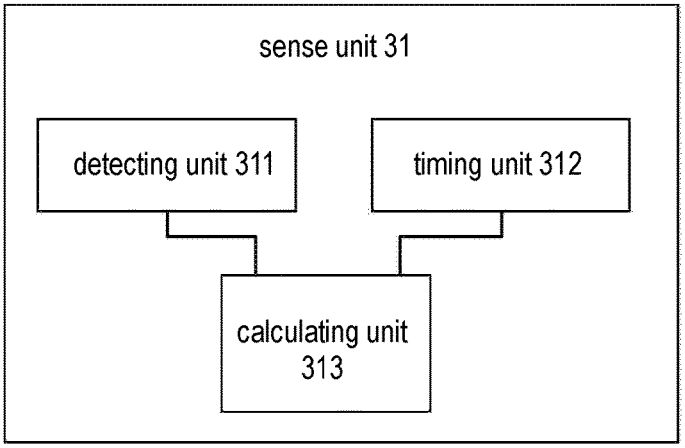
FIG. 2 is a composition diagram of a sense unit in the invention.

FIG. 2 is a composition diagram of a sense unit 31 in the invention. As shown in FIG. 2, the sense unit 31 comprises a detecting unit 311 for acquiring a unique identity identifier of an ID chip 111 in an atomizing core 11 and stored information of a remaining life cycle memory element 112 after the electronic cigarette is powered to judge whether a disable lock identifier exists, and for timely detecting operation parameters N including operation power, voltage, temperature, times of mouth suction and the like of the atomizing core 11 after completion of ignition of the electronic cigarette; a timing unit 312 for recording an operation time T of the atomizing core 11; and a calculating unit 313 for timely calculating consumed life cycle $L_{used}=a*N*T$, wherein a is a correction factor, and timely calculating latest remaining life cycle $L_{max}=L_{max}-L_{used}$ of the atomizing core 11 in the case of the operation parameters N and the operation time T based on the initial maximum remaining life cycle $L_{max}$ acquired from the remaining life cycle memory element 112 of the atomizing core 11. Here, due to consideration of the problem of time the user uses the electronic cigarette, a time interval shall be set during calculation of the latest remaining life cycle of the atomizing core 11. For example, data recorded every one minute are calculated to obtain the latest remaining life cycle for subsequent comparison and writing operations. The time interval of one minute is only an example, and it is not limited thereto. The optimal time interval can be obtained by the method of investigation of using habits of the user, and the like.

The compare unit 32 compares the latest remaining life cycle sensed by the sense unit 31 with a preset threshold value to judge whether the latest remaining life cycle has reached the preset threshold value. If yes, a message command is sent to the control unit 33 through which the disable lock identifier is written into the remaining life cycle memory element 112 of the atomizing core 11, and disconnection of power connection between the battery assembly 2 and the atomizer and the reminder unit 34 sending the reminding message of exchanging the atomizing core 11 to the user are controlled. The reminding message comprises lamp flickering or voice prompt, but it is not limited thereto. If no, the latest remaining life cycle is updated into the remaining life cycle memory element 112 of the atomizing core 11 through the control unit 33, and operations of the sense unit 31 are continued to be performed. Preferably, the control unit 33 of the invention is an MCU.

Figure 3:
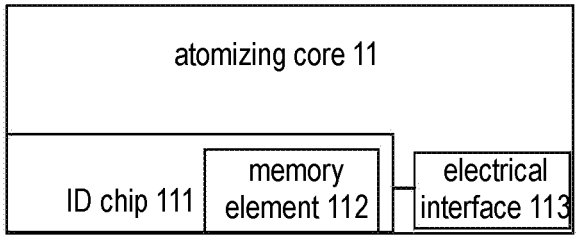
FIG. 3 is a structural diagram of an atomizing core in the invention.

As for the second embodiment, please refer to FIG. 3, which is a structural diagram of an atomizing core in the invention. The atomizing core 11 is detachably mounted on an atomizer body, and comprises an atomizing core body, an identity identification element 111 mounted in the atomizing core body for identifying identity of the atomizing core 11, and a first electrical interface 113 electrically connected to the atomizer body, the identity identification element 111 being electrically connected to the first electrical interface 113, and the atomizing core 11 further comprises a remaining life cycle memory element 112.

In the atomizing core 11 of the invention, the remaining life cycle memory element 112 is disposed in the identity identification element 111, the identity identification element 111 is an ID chip, the remaining life cycle memory element 112 is a readable and writable memory, and the atomizer body is provided with a second electrical interface 12 electrically connected to the atomizing core 11. The second electrical interface 12 and the first electrical interface 113 are used for electrically connection to transmit data, and also completing mechanical connection and fixing.

Figure 4:
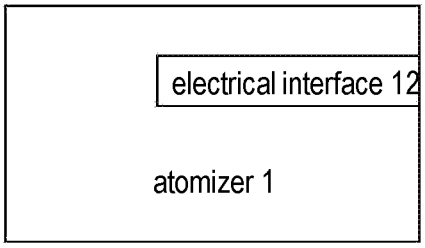
FIG. 4 is a structural diagram of an atomizer in the invention.

As for the third embodiment, please refer to FIG. 4, which is a structural diagram of an atomizer in the invention. An atomizer 1 comprises an atomizer body detachably connected to an atomizing core 11, and the atomizer body is provided with a second electrical interface 12 electrically connected to the atomizing core 11. Specifically, the second electrical interface 12 and a first electrical interface 113 on the atomizing core 11 are used for electrically connection to transmit data, and also completing mechanical connection and fixing. In some other embodiments, the atomizer body is also provided with a memory element for storing attenuation data of the atomizing core, and when making specific records, attenuation data of the atomizing core corresponding to the atomizing core ID are recorded. Details are not described here.

Figure 5:
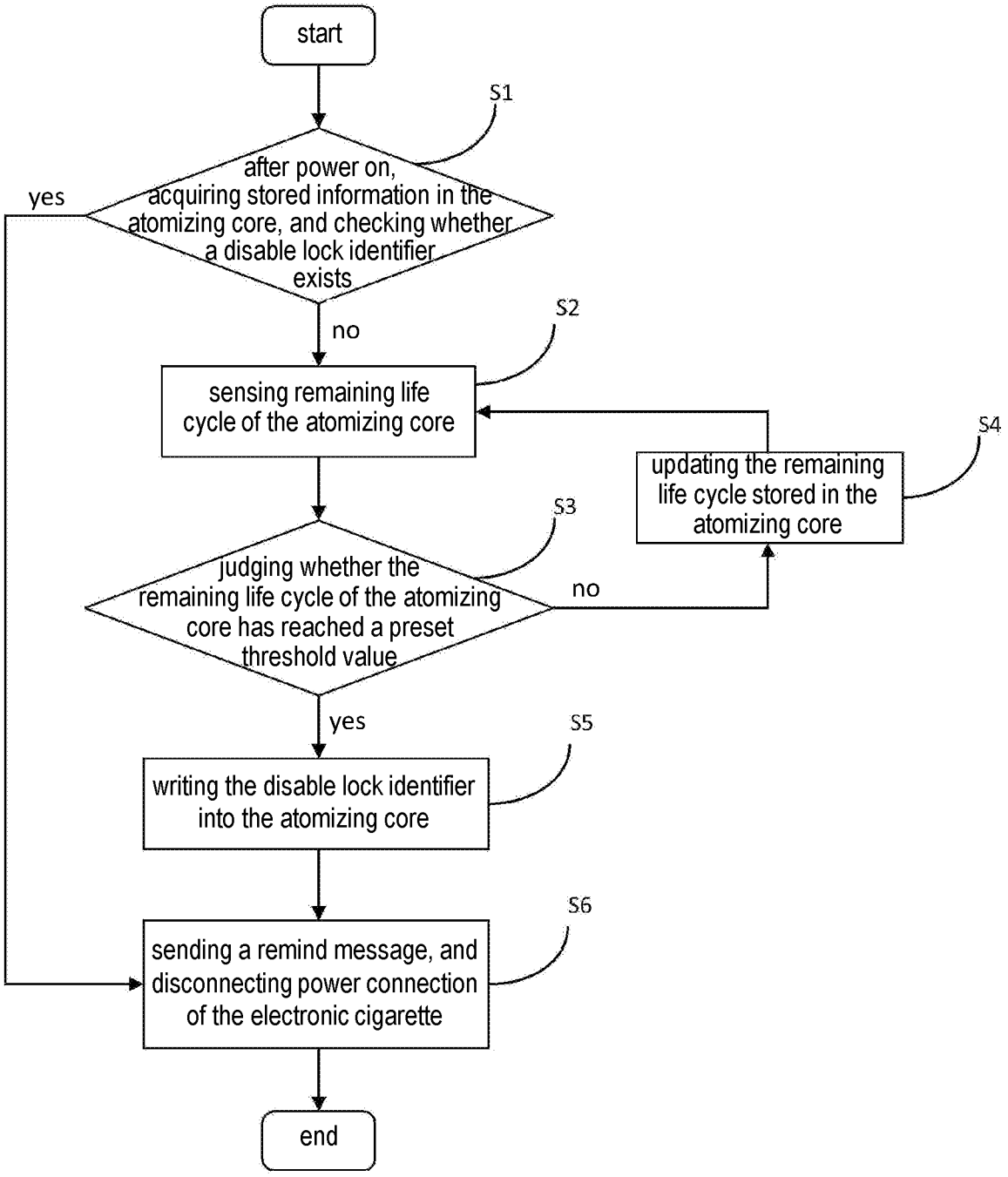
FIG. 5 is a flow diagram of a method of controlling an electronic cigarette in the invention.

As for the fourth embodiment, please refer to FIG. 5, which is a flow diagram of a method of controlling an electronic cigarette in the invention. In a method of controlling an electronic cigarette, the electronic cigarette comprises a battery assembly 2, an atomizer 1 comprising an atomizer body and an atomizing core 11 detachably mounted on the atomizer body, and a main control circuit 3, and the method comprises steps of:

S1: after power on, acquiring stored information in the atomizing core 11, checking whether a disable lock identifier exists, if yes, executing step S6, otherwise, executing step S2;

S2: sensing remaining life cycle of the atomizing core 11;

S3: judging whether the remaining life cycle of the atomizing core 11 has reached a preset threshold value, if yes, executing step S5, otherwise, executing step S4;

S4: updating the remaining life cycle stored in the atomizing core 11, and continuing to execute the step S2;

S5: writing the disable lock identifier into the atomizing core 11; and

S6: sending a reminding message, and disconnecting power connection of the electronic cigarette.

In the method of controlling an electronic cigarette of the invention, the step S1 further comprises: after power on, acquiring identity identification of an identity identification element 111 in the atomizing core 11 and stored information of a remaining life cycle memory element 112 in the atomizing core 11 through a first electrical interface 113 on the atomizing core 11.

The step S2 further comprises: recording operation time of the atomizing core 11, timely acquiring operation parameters of the atomizing core 11 through the first electrical interface 113 on the atomizing core 11, timely calculating consumed life cycle based on the acquired operation time and operation parameters, and obtaining latest remaining life cycle.

The step S4 further comprises: updating the latest remaining life cycle into the remaining life cycle memory element 112 of the atomizing core 11.

The step S5 further comprises: writing the disable lock identifier into the remaining life cycle memory element 112 of the atomizing core 11.

Specifically, the method of controlling an electronic cigarette of the invention comprises steps of:

S1: after power on, but before completion of ignition, a detecting unit 311 in the main control circuit 3 acquires identity identification of the identity identification element 111 in the atomizing core 11 and stored information of the remaining life cycle memory element 112 in the atomizing core 11, i.e., initial maximum remaining life cycle, through the first electrical interface on the atomizing core 11, checks whether the stored information of the remaining life cycle memory element 112 has the disable lock identifier. If yes, step S6 is executed, and if no, step S2 is executed.

S2: the detecting unit 311 in the main control circuit 3 timely acquires operation parameters N of the atomizing core 11 through the first electrical interface on the atomizing core 11, the operation parameters including operation power, voltage, temperature, times of mouth suction and the like, an operation time T of the atomizing core 11 is recorded through a timing unit 312, and consumed life cycle $L_{used}=a*N*T$ is timely calculated based on the acquired operation time T and operation parameters N, wherein a is a correction factor.

Moreover, latest remaining life cycle $L_{max}=L_{max}-L_{used}$ of the atomizing core 11 is timely calculated in the case of the operation parameters N and the operation time T based on the initial maximum remaining life cycle $L_{max}$ acquired in the step S1. Here, due to consideration of the problem of time the user uses the electronic cigarette, a time interval shall be set during calculation of the latest remaining life cycle of the atomizing core 11. For example, data recorded every one minute are calculated to obtain the latest remaining life cycle for subsequent comparison and writing operations. The time interval of one minute is only an example, and it is not limited thereto. The optimal time interval can be obtained by the method of investigation of using habits of the user, and the like.

S3: the compare unit 32 compares the latest remaining life cycle sensed by the sense unit 31 with a preset threshold value to judge whether the latest remaining life cycle has reached the preset threshold value. If yes, step S5 is executed. The reminding message comprises lamp flickering or voice prompt, but it is not limited thereto. If no, step S4 is executed.

S4: the latest remaining life cycle is updated into the remaining life cycle memory element 112 of the atomizing core 11 through the control unit 33, and sensing operation in the step S2 is continued to be executed.

S5: the disable lock identifier is written into the remaining life cycle memory element 112 of the atomizing core 11 through the control unit 33.

S6: the control unit 33 controls disconnection of power connection between the battery assembly 2 and the atomizer 1, and controls the reminder unit 34 to send a reminding message of exchanging the atomizing core 11 to the user.

Implementing an electronic cigarette, an atomizing core, an atomizer and a method of controlling the electronic cigarette of the invention has the following advantageous effects: since the present invention designs the identity identification element, electrical interfaces and remaining life cycle memory element in the atomizing core, the user can use the atomizing core in any atomizer body having electrical interfaces anytime and anywhere, can accurately acquire whether the service life of the atomizing core has reached an upper limit in different atomizers, and close output at an optimal time of taste of the atomizing core and before producing harmful substances, so that the atomizing core stops working, and the user is reminded to exchange a new atomizing core to ensure body health of the user.

The invention is described by specific embodiments, and those skilled in the art shall understand that various variations and equivalent replacements also can be made to the invention without departing from extent of the invention. In addition, with respect to particular circumstances or specific conditions, various modifications can be made to the invention without departing from the extent of the invention. Therefore, the invention is not limited to the disclosed specific embodiments, but shall include all embodiments falling into the extent of the claims of the invention.

What is claimed is:

1. An electronic cigarette, comprising a battery assembly, an atomizer comprising an atomizer body and an atomizing core mounted on the atomizer body, and a main control circuit, wherein the main control circuit comprises a sense unit for sensing remaining life cycle of the atomizing core, a compare unit for comparing data sensed by the sense unit with a preset threshold value, the atomizing core is detachably mounted on the atomizer body, the atomizing core comprises an atomizing core body, an identity identification element mounted in the atomizing core body for identifying identity of the atomizing core, a remaining life cycle memory element and a first electrical interface electrically connected to the atomizer body, the identity identification element being electrically connected to the first electrical interface, the atomizer body is provided with a second electrical interface electrically connected to the atomizing core, the second electrical interface is electrically connected to the main control circuit, the second electrical interface and the first electrical interface are used for an electrical connection to transmit data, and completing mechanical connection and fixing between the atomizing core and the atomizer body, and a control unit for controlling on and off of the electronic cigarette depending on comparison results.

2. The electronic cigarette according to claim 1, wherein the remaining life cycle memory element is disposed in the identity identification element.

3. The electronic cigarette according to claim 2, wherein the identity identification element is an ID chip.

4. The electronic cigarette according to claim 1, wherein the identity identification element is an ID chip.

5. The electronic cigarette according to claim 1, wherein the remaining life cycle memory element is a readable and writable memory.

6. The electronic cigarette according to claim 1, wherein the main control circuit further comprises a reminder unit for sending a reminding message of exchanging the atomizing core.

7. The electronic cigarette according to claim 6, wherein the main control circuit is disposed in the battery assembly.

* * * * *